US008855893B2

(12) United States Patent
Oe et al.

(10) Patent No.: US 8,855,893 B2
(45) Date of Patent: Oct. 7, 2014

(54) VALVE TIMING CONTROL APPARATUS

(75) Inventors: Shuhei Oe, Nukata-gun (JP); Hiroya Andou, Nishio (JP); Jun Yamada, Okazaki (JP); Takehiro Tanaka, Okazaki (JP); Yoshihito Moriya, Nagoya (JP)

(73) Assignees: Nippon Soken, Inc., Nishio (JP); Denso Corporation, Kariya (JP); Toyota Jidosha Kabushiki Kaisha, Toyota (JP)

( * ) Notice: Subject to any disclaimer, the term of this patent is extended or adjusted under 35 U.S.C. 154(b) by 279 days.

(21) Appl. No.: 13/196,057

(22) Filed: Aug. 2, 2011

(65) Prior Publication Data

US 2012/0042841 A1 Feb. 23, 2012

(30) Foreign Application Priority Data

Aug. 19, 2010 (JP) ..... 2010-184220

(51) Int. Cl.
*F01L 1/34* (2006.01)
*F01L 1/344* (2006.01)

(52) U.S. Cl.
CPC ..... *F01L 1/3442* (2013.01); *F01L 2001/34436* (2013.01); *F01L 2001/34456* (2013.01); *F01L 2001/34483* (2013.01)
USPC ..... 701/104; 123/90.17

(58) Field of Classification Search
CPC .... F01L 1/34; F02D 13/0219; F02D 13/0261; F02D 13/0276; Y02T 10/18
USPC ..... 123/90.17, 90.31, 345–348; 701/103, 701/110, 114
See application file for complete search history.

(56) References Cited

U.S. PATENT DOCUMENTS

| | | | | |
|---|---|---|---|---|
| 6,263,846 | B1 * | 7/2001 | Simpson et al. | 123/90.17 |
| 6,502,535 | B2 * | 1/2003 | Nakamura | 123/90.15 |
| 6,505,585 | B1 | 1/2003 | Machida et al. | |
| 6,656,089 | B2 * | 12/2003 | Furukawa | 477/111 |
| 8,061,311 | B2 * | 11/2011 | Nakamura | 123/90.16 |
| 8,640,662 | B2 * | 2/2014 | Cole et al. | 123/90.17 |
| 2006/0037570 | A1 * | 2/2006 | Hitomi et al. | 123/90.15 |
| 2010/0050965 | A1 * | 3/2010 | Nakamura | 123/90.15 |
| 2011/0088644 | A1 * | 4/2011 | Nakamura | 123/90.15 |
| 2013/0180486 | A1 * | 7/2013 | Smith | 123/90.17 |
| 2014/0033999 | A1 * | 2/2014 | Kobayashi et al. | 123/90.17 |
| 2014/0076254 | A1 * | 3/2014 | Toma et al. | 123/90.17 |

FOREIGN PATENT DOCUMENTS

| | | |
|---|---|---|
| JP | 9-236003 | 9/1997 |

* cited by examiner

*Primary Examiner* — Thomas Moulis
*Assistant Examiner* — Elizabeth Hadley
(74) *Attorney, Agent, or Firm* — Nixon & Vanderhye P.C.

(57) ABSTRACT

A valve timing control apparatus includes a housing that is rotatable with a crankshaft; a vane rotor that is rotatable with a camshaft; and a phase controller to compulsorily change a rotation phase of the vane rotor alternately between an advance side and a retard side with respect to the housing if an engine shifts to a high rotation state after the engine continuously has a low rotation state for a predetermined period or more. The engine in the low rotation state has a rotation speed lower than a predetermined rotation speed. The engine in the high rotation state has a rotation speed equal to or higher than the predetermined rotation speed.

10 Claims, 11 Drawing Sheets

VALVE TIMING CONTROL APPARATUS

CROSS REFERENCE TO RELATED APPLICATION

This application is based on Japanese Patent Application No. 2010-184220 filed on Aug. 19, 2010, the disclosure of which is incorporated herein by reference in its entirety.

BACKGROUND OF THE INVENTION

1. Field of the Invention

The present invention relates to a valve timing control apparatus.

2. Description of Related Art

Conventionally, a fluid-drive valve timing control apparatus is known, and has a housing rotatable with a crankshaft and a vane rotor rotatable with a camshaft. A valve timing is controlled by working fluid supplied from a supply source, synchronized with a rotation of an engine. The control apparatus controls working fluid to flow into or out of operation chambers partitioned by vanes of the vane rotor in a rotating direction inside of the housing, thereby changing a rotation phase of the vane rotor relative to the housing.

A variation torque is applied to the vane rotor from the camshaft so as to bias the vane rotor alternately between an advance side and a retard side with respect to the housing. When the rotation phase of the vane rotor is changed with respect to the housing, the variation torque is applied to the advance side or the retard side. At this time, a volume of the operation chamber is instantaneously enlarged. If introduction of working fluid becomes late relative to the operation chamber, inside pressure of the enlarged chamber becomes negative, that is, becomes lower than atmospheric pressure, so that air outside of the apparatus is drawn into the enlarged chamber through a clearance. The drawn air has foam or bubble state in the chamber, and is mixed into working fluid in the chamber. Coefficient of elasticity of the mixed air foam is small in the chamber, so that the vane rotor may have abnormal movement by elastic reaction force generated to the variation torque. In this case, accurate controlling of the valve timing becomes difficult.

JP-A-2000-345869 (U.S. Pat. No. 6,505,585) describes a valve timing control apparatus, that compulsorily changes a rotation phase into an advance side and a retard side with respect to the housing. That is, working fluid is controlled to flow into or out of a chamber so as to discharge air foam from the chamber. The compulsory change of the rotation phase is performed if a rotation speed of an engine exceeds a predetermined speed in JP-A-2000-345869.

However, even when the rotation speed of the engine exceeds the predetermined speed, the chamber may not always have the air foam, so that the compulsory change of the rotation phase may be performed in vain. Specifically, while the engine continues to have high rotation, a pressure of working fluid supplied from a supply source is high in synchronization with the engine rotation. In this case, introduction of working fluid is not late, so that the mixing of air foam is not generated.

That is, even if the engine instantaneously has a low rotation in such high rotation state, the compulsory change of the rotation phase is unnecessary, because the mixing of air foam is not generated. Rather, the compulsory change of the rotation phase may cause a rapid change in operation state of the engine. Therefore, it is desirable to perform the compulsory change of the rotation phase pinpointly at a timing necessary for preventing the abnormal movement of the vane rotor.

SUMMARY OF THE INVENTION

In view of the foregoing and other problems, it is an object of the present invention to provide a valve timing control apparatus.

According to an example of the present invention, a valve timing control apparatus controls valve timing of a valve that is opened or closed by a camshaft through torque transmitted from a crankshaft in an engine of a vehicle. The valve timing is controlled using working fluid supplied from a supply source in synchronization with a rotation of the engine. The valve timing control apparatus includes a housing that is rotatable with the crankshaft; a vane rotor that is rotatable with the camshaft; and a phase controller. The vane rotor has vanes partitioning an inside of the housing into plural operation chambers in a rotating direction. The vane rotor has a rotation phase with respect to the housing, and the rotation phase is changed by working fluid flowing into or out of the operation chambers. The phase controller compulsorily changes the rotation phase alternately between an advance side and a retard side with respect to the housing by controlling working fluid to flow into or out of the operation chambers if the engine shifts to a high rotation state after the engine continuously has a low rotation state for a predetermined period or more. The engine in the low rotation state has a rotation speed lower than a predetermined rotation speed, and the engine in the high rotation state has a rotation speed equal to or higher than the predetermined rotation speed.

While the engine is in the low rotation state, a pressure of working fluid supplied from the supply source is low. Therefore, introduction of working fluid into the chamber may become late, so that air foam is easily mixed into the introduced working fluid. The compulsory change of the rotation phase is performed only when the air foam is mixed into the introduced working fluid and when the vane rotor may have abnormal movement by shifting to the high rotation state. Further, the compulsory change of the rotation phase is performed alternately between the advance side and the retard side by controlling working fluid whose pressure is raised by the rotation of the engine, so that the air foam can be discharged out of the chamber and that the vane rotor can be prevented from having the abnormal movement.

Thus, the compulsory change of the rotation phase is pinpointly performed at a necessary time. Therefore, a rapid change in the engine operation state is restricted from being generated, and the valve timing can be accurately controlled.

For example, the phase controller compulsorily changes the rotation phase alternately between a most advance phase and a most retard phase with respect to the housing if the engine shifts to the high rotation state after the engine continuously has the low rotation state for the predetermined period or more. Therefore, the vane rotor can be rotated at the maximum relative to the housing, so that the air foam can be discharged out of the chamber. Because the vane rotor can be prevented from having the abnormal movement, the valve timing can be accurately controlled.

For example, in an abnormality case where the rotation phase does not reach one of the most advance phase and the most retard phase even when the rotation phase is compulsorily changed, the phase controller compulsorily locks the rotation phase into the other of the most advance phase and the most retard phase. When the rotation phase is compulsory locked, the rotation of the vane rotor can be stopped. Therefore, when the abnormality is generated, fail-safe can be achieved.

For example, the phase controller compulsorily changes the rotation phase, if the engine shifts to the high rotation state after the engine continuously has the low rotation state for the predetermined period or more, and if a temperature of working fluid is higher than a predetermined temperature. If the temperature of working fluid is raised, a viscosity of working fluid is lowered. At this time, formation of oil film becomes difficult, so that air foam is easily mixed into working fluid. However, the engine is restricted from having a rapid change in the operation state, due to the compulsory change of the rotation phase.

For example, the phase controller compulsorily changes the rotation phase, if the engine shifts to the high rotation state after the engine continuously has the low rotation state for the predetermined period or more, and if a fuel injection is cut in the engine. When the fuel injection for the engine is cut, fuel combustion in the engine is stopped, so that the rapid change is less generated in the engine operation state. The engine is restricted from having a rapid change in the operation state, due to the compulsory change of the rotation phase.

For example, he phase controller stops the compulsorily changing of the rotation phase when a period necessary for discharging air foam from the operation chambers is elapsed. The compulsory change of the rotation phase is performed only in a limited period necessary for discharging the air foam, so as to restrict the engine from having a rapid change in the operation state.

According to an example of the present invention, a valve timing control apparatus controls valve timing of a valve that is opened or closed by a camshaft through torque transmitted from a crankshaft in an engine of a vehicle. The valve timing is controlled using working fluid supplied from a supply source in synchronization with a rotation of the engine. The valve timing control apparatus includes a housing that is rotatable with the crankshaft; a vane rotor that is rotatable with the camshaft; and a phase controller. The vane rotor has vanes partitioning an inside of the housing into plural operation chambers in a rotating direction. The vane rotor has a rotation phase with respect to the housing, and the rotation phase is changed by working fluid flowing into or out of the operation chambers. The phase controller compulsorily locks the rotation phase into a predetermined phase by controlling working fluid to flow into or out of the operation chambers if the engine shifts to a high rotation state after the engine continuously has a low rotation state for a predetermined period or more. The engine in the low rotation state has a rotation speed lower than a predetermined rotation speed, and the engine in the high rotation state has a rotation speed equal to or higher than the predetermined rotation speed.

While the engine is in the low rotation state, a pressure of working fluid supplied from the supply source is low. Therefore, introduction of working fluid into the chamber may be late, so that air foam is easily mixed into the introduced working fluid. The compulsory lock of the rotation phase is performed only when the air foam is mixed into the introduced working fluid and when the vane rotor may have abnormal movement by shifting to the high rotation state. Further, the compulsory lock of the rotation phase stops the relative rotation of the vane rotor including the abnormal movement.

The compulsory lock of the rotation phase is pinpointly performed at a necessary time. Therefore, the engine is restricted from having a rapid change in the operation state, so that the valve timing can be accurately controlled.

For example, the predetermined phase is a most advance phase or a most retard phase that is closer to a rotation phase when the engine shifts to the high rotation state after the engine continuously has the low rotation state for the predetermined period or more. A time necessary for reaching the predetermined phase can be shortened. Because the vane rotor can be prevented from having the abnormal movement in the shortened time, the valve timing can be accurately controlled.

For example, the phase controller compulsorily locks the rotation phase, if the engine shifts to the high rotation state after the engine continuously has the low rotation state for the predetermined period or more, and if a temperature of working fluid is higher than a predetermined temperature. If the temperature of working fluid is raised, a viscosity of working fluid is lowered. At this time, formation of oil film becomes difficult, so that air foam is easily mixed into working fluid. However, the engine can be restricted from having a rapid change in the operation state, due to the compulsory lock of the rotation phase.

For example, the phase controller compulsorily locks the rotation phase, if the engine shifts to the high rotation state after the engine continuously has the low rotation state for the predetermined period or more, and if a fuel injection is cut in the engine. When the fuel injection for the engine is cut, fuel combustion in the engine is stopped, so that the rapid change is less generated in the engine operation state. The compulsory lock of the rotation phase can restrict the engine from having a rapid change in the operation state.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENT

First Embodiment

Figure 1:
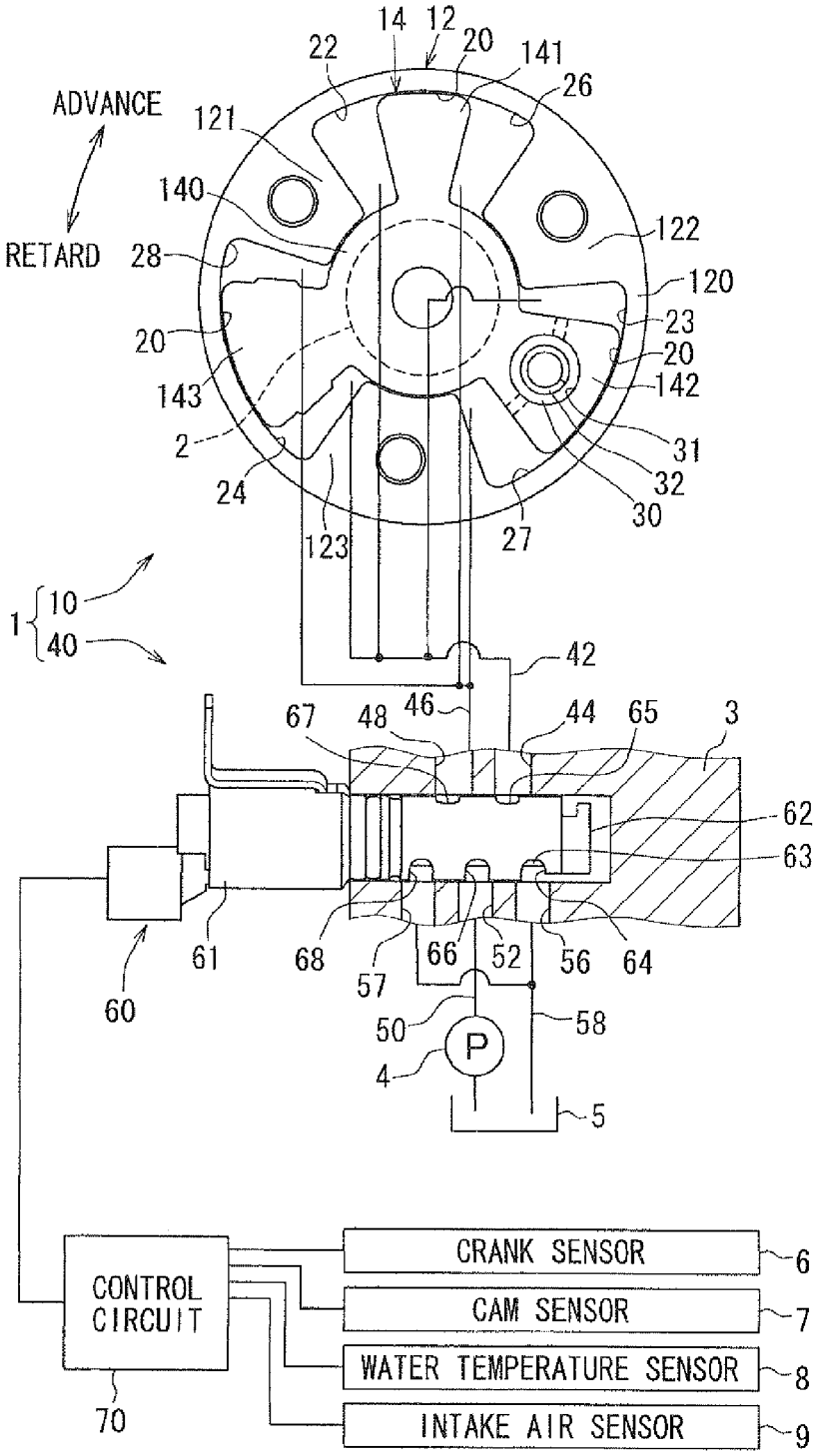
FIG. 1 is a schematic view illustrating a valve timing control apparatus according to a first embodiment.

A valve timing control apparatus 1 according to a first embodiment of the present invention is applied to an internal combustion engine of a vehicle, for example. The valve timing control apparatus 1 controls valve timing of an intake valve serving as a "valve" that is opened or closed by a camshaft 2 using working oil serving as "working fluid". As shown in FIG. 1, the valve timing control apparatus 1 has a driving unit 10 and a controller 40. The driving unit 10 is provided in a driving force transmission system to transmit a driving force of a crankshaft (not shown) of the internal combustion engine to the camshaft 2, and is driven with working oil. The controller 40 controls supply of working oil to the driving unit 10.

(Driving Unit)

The driving unit 10 has a housing 12 made of metal. The housing 12 has a cylindrical portion 120, and multiple shoes 121, 122, 123 serving as partition members. The respective shoes 121, 122, 123 are arranged in the cylindrical portion 120 at positions at approximately equal intervals in the rotation direction and project from the cylindrical portion 120 inwardly in a radial direction from above arranged positions. Each chamber 20 is respectively formed between the shoes 121, 122, 123 located adjacent with each other in the rotation direction.

The housing 12 further has a sprocket (not shown), and plural teeth are arranged on the sprocket in the rotation direction. The housing 12 is coupled to the crankshaft via a timing chain (not shown) engaged with the teeth of the sprocket. During running of the internal combustion engine, because the driving force is transmitted from the crankshaft to the sprocket, the housing 12 is rotated with the crankshaft in the clockwise direction in FIG. 1.

A vane rotor 14 made of metal is accommodated in the housing 12 coaxially with the housing 12. The vane rotor 14 has a columnar rotation shaft 140 and vanes 141, 142, 143.

The shaft 140 is coaxially fixed to the camshaft 2. In this arrangement, the vane rotor 14 is rotated with the camshaft 2 in the clockwise direction in FIG. 1 and is relatively rotatable with respect to the housing 12. The respective vanes 141, 142, 143 are arranged at positions of the shaft 140 at approximately equal intervals in the rotation direction and projected outward in the radial direction from the above positions. The vanes 141, 142, 143 are accommodated in respectively corresponding chambers 20.

Each of the vanes 141, 142, 143 defines an operation chamber 22, 23, 24, 26, 27, 28 in the housing 12 by partitioning the corresponding chamber 20 in the rotation direction. More particularly, an advance chamber 22 is formed between the shoe 121 and the vane 141; an advance chamber 23 is formed between the shoe 122 and the vane 142; and an advance chamber 24 is formed between the shoe 123 and the vane 143. Further, a retard chamber 26 is formed between the shoe 122 and the vane 141; a retard chamber 27 is formed between the shoe 123 and the vane 142; and a retard chamber 28 is formed between the shoe 121 and the vane 143.

The vane 142 has an accommodation chamber 31 to reciprocably accommodate a column-shaped lock member 30 coaxially. The accommodation chamber 31 communicates with the advance chamber 23 and the retard chamber 27 which oppose with each other in the rotation direction through the vane 142. The lock member 30 is slidably guided by an inner circumference wall of the accommodation chamber 31.

The lock member 30 is fitted with a fitting hole (not shown) of the housing 12 by receiving a force generated from a compression coil spring 32, so as to lock the vane rotor 14 with respect to the housing 12. For example, the vane rotor 14 is locked at a middle lock phase (see FIG. 1) where the vane rotor 14 has a relative phase with respect to the housing 12 between the most advance phase and the most retard phase.

The lock member 30 is separated from the fitting hole of the housing 12 by receiving a pressure of working oil introduced into the accommodation chamber 31 through at least one of the advance chamber 23 and the retard chamber 27. Thus, the vane rotor 14 is unlocked relative to the housing 12.

While the rotation phase is unlocked, working oil flows into or out of each operation chamber 22, 23, 24, 26, 27, 28, thereby changing the rotation phase so as to control the valve timing. Specifically, when working oil flows into the advance chamber 22, 23, 24 and when working oil flows out of the retard chamber 26, 27, 28, the rotation phase is changed toward the advance side, so that the valve timing is advanced. Therefore, the vane 143 contacts the shoe 121 on the advance side in the rotation direction, thereby limiting the rotation phase to the most advance phase.

While the rotation phase is unlocked, when working oil flows into the retard chamber 26, 27, 28, and when working oil flows out of the advance chamber 22, 23, 24, the rotation phase is changed toward the retard side, so that the valve timing is retarded. Therefore, the vane 143 contacts the shoe 123 on the retard side in the rotation direction, thereby limiting the rotation phase to the most retard phase.

While the rotation phase is unlocked, when working oil stays in each of the retard chamber 26, 27, 28 and the advance chamber 22, 23, 24, the rotation phase and the valve timing are maintained within a range influenced by a variation torque.

The variation torque is a torque generated by a spring reaction force, for example, from an intake valve that is opened or closed by the camshaft 2 while the engine is active. Further, the torque is transmitted from the camshaft 2 to the vane rotor 14.

Figure 2:
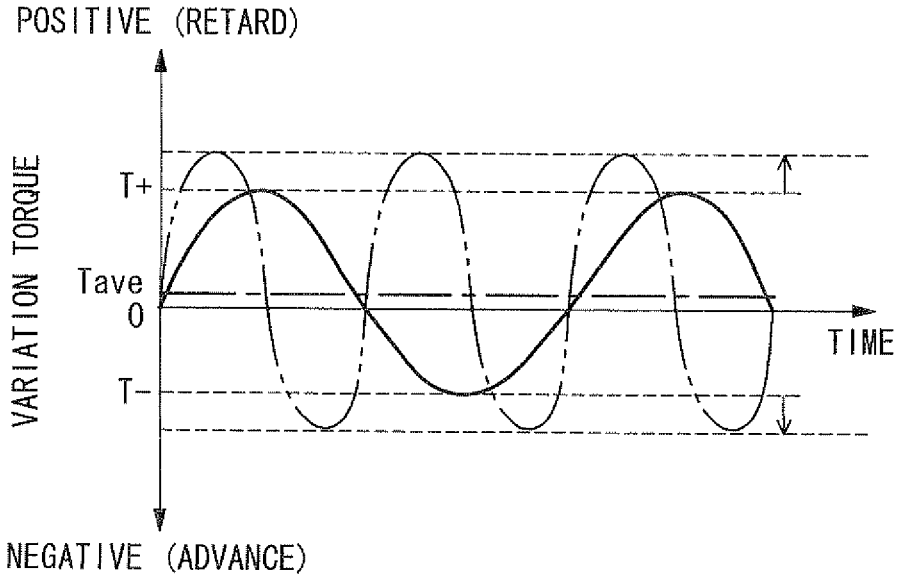
FIG. 2 is a characteristic view illustrating a variation torque applied to a vane rotor of the valve timing control apparatus.

As shown in FIG. 2, the variation torque alternately has positive value and negative value in accordance with rotation of the engine (camshaft 2). The vane rotor 14 is biased toward the advance side with respect to the housing 12, when the variation torque has the negative value. The vane rotor 14 is biased toward the retard side with respect to the housing 12, when the variation torque has the positive value.

As shown in a double-chain line of FIG. 2, a positive/negative peak T+, T− of the variation torque is raised as a rotation speed of the engine (camshaft 2) is made higher. Further, the positive peak T+ is larger than the negative peak T−, so that an average torque Tave is biased toward the retard (positive) side.

(Controller)

As shown in the controller 40 of FIG. 1, an advance passage 42 is provided to pass through the camshaft 2 and the vane rotor 14, and communicates with the advance chambers 22, 23, 24. The advance passage 42 is connected to an advance communication hole 44 defined in a fixed portion 3 such as cylinder head or cam cover of the engine.

Further, a retard passage 46 is provided to pass through the camshaft 2 and the vane rotor 14, and communicates with the retard chambers 26, 27, 28. The retard passage 46 is connected to a retard communication hole 48 defined in the fixed portion 3.

A supply passage 50 makes an inlet port 52 of the fixed portion 3 and a pump 4 to communicate with each other. The pump 4 may be a mechanical pump driven by a rotation of the crankshaft. Working oil is pumped up with the pump 4 from an oil pan 5, and the pumped oil is continuously supplied to the supply passage 50. Therefore, a pressure of working oil supplied from the pump 4 is lowered as a rotation speed of the engine is made slower.

A drain passage 58 is provided in the fixed portion 3, and communicates with drain ports 56, 57 in a manner that working oil is discharged into the oil pan 5. The oil pan 5 is placed outside of a control valve 60, and is released to outside air.

The control valve 60 accommodated in the fixed portion 3 is a solenoid valve which linearly and reciprocably drives a spool 63 in a sleeve 62 utilizing an electromagnetic driving force generated by a solenoid 61 and an elastic biasing force generated by a return spring (not shown). The sleeve 62 has an advance drain port 64, an advance communication port 65, an inlet port 66, a retard communication port 67 and a retard drain port 68 in this order from an end to the other end in the axis direction.

The advance drain port 64 communicates with the advance drain port 56, and the retard drain port 68 communicates with the retard drain port 57. The advance communication port 65 communicates with the advance communication port 44, and the retard communication port 67 communicates with the retard communication port 48. The inlet port 66 communicates with the inlet port 52. Connection states among the ports 64, 65, 66, 67, 68 are switched in accordance with energization state of the solenoid 61.

A control circuit 70 is an electronic circuit having a microcomputer, for example, and is electrically connected to the solenoid 61 of the control valve 60. The control circuit 70 is further electrically connected to a crank sensor 6, a cam sensor 7, a water temperature sensor 8 and an intake air sensor 9. The crank sensor 6 detects a rotation of the crankshaft, and the cam sensor 7 detects a rotation of the camshaft 2. The water temperature sensor 8 detects a temperature of cooling water of the engine. The intake air sensor 9 detects an intake air amount of the engine based on an opening degree of a throttle. The control circuit 70 controls the engine including the energization of the solenoid 61 by executing a program memorized in an internal memory based on signals output from the sensor 6, 7, 8, 9.

In the controller 40, the control circuit 70 drives the spool 63 by controlling the energization of the solenoid 61, thereby switching the connection states among the ports 64, 65, 66, 67, 68 so as to control flow of working oil with respect to the chambers 22, 23, 24, 26, 27, 28.

More specifically, when the spool 63 is driven to an advance position, the ports 66, 65 are connected with each other, and the ports 68, 67 are connected with each other, so that working oil supplied from the pump 4 flows into the advance chambers 22, 23, 24. Further, working oil is discharged into the drain pan 5 from the retard chambers 26, 27, 28. Thus, the rotation phase is changed into the advance side, and the valve timing is advanced.

In contrast, when the spool 63 is driven to a retard position, the ports 65, 64 are connected with each other, and the ports 66, 67 are connected with each other, so that working oil supplied from the pump 4 flows into the retard chambers 26, 27, 28. Further, working oil is discharged into the drain pan 5 from the advance chambers 22, 23, 24. Thus, the rotation phase is changed into the retard side, and the valve timing is retarded.

Further, when the spool 63 is driven to a holding position, the ports 65, 67 are mutually disconnected, and both of the ports 65, 67 are disconnected with respect to the ports 64, 66, 68. Working oil is stored in each of the retard chambers 26, 27, 28 and the advance chambers 22, 23, 24. Thus, the rotation phase and the valve timing are maintained within a range influenced by the variation torque.

(Control Flow)

Figure 3:
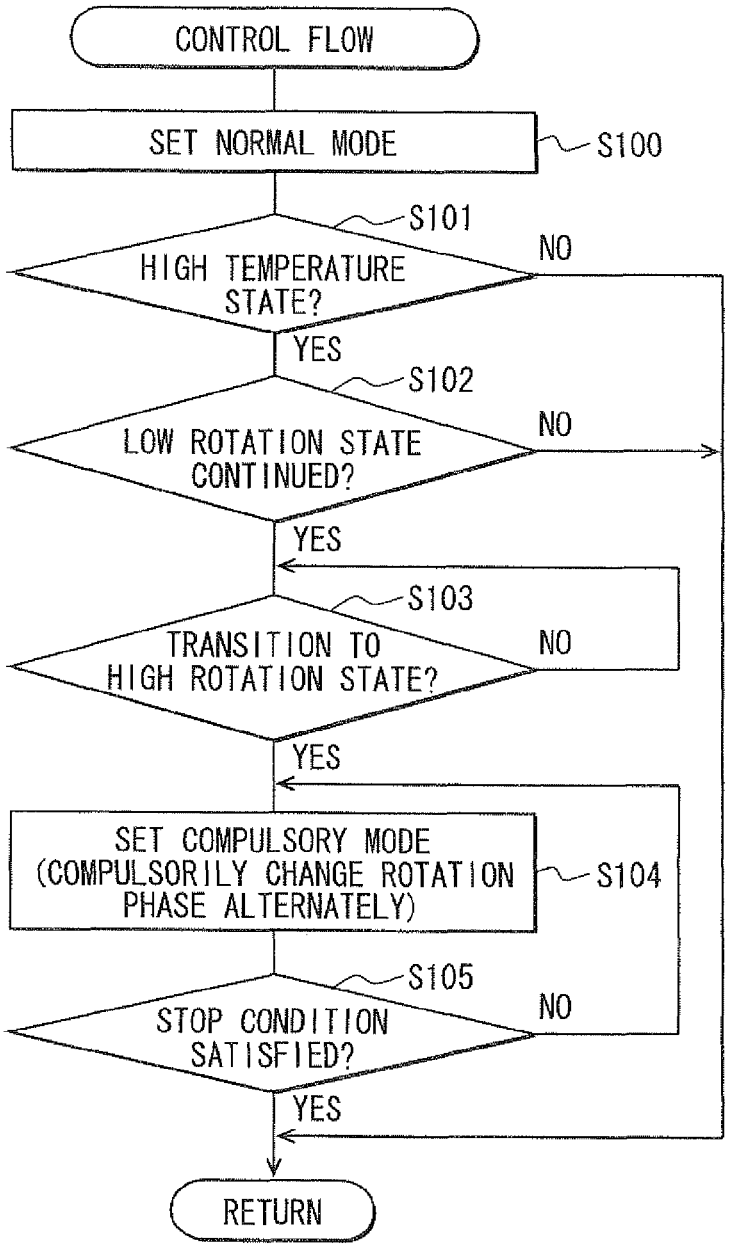
FIG. 3 is a flow chart illustrating a control flow performed by a control circuit of the valve timing control apparatus.

A flow of control performed by the control circuit 70 is described with reference to FIG. 3. The control flow is started when the engine is activated by turning on an engine switch of the vehicle, and is ended when the engine is stopped by turning off the engine switch, for example.

In S100 of the control flow, a normal mode is set as an engine control status. In the normal mode, flow of working oil is controlled relative to the chambers 22, 23, 24, 26, 27, 28 by controlling the energization of the solenoid 61, so as to realize the optimal valve timing for operation state of the engine. Thus, the rotation phase is controlled among the advance position, the retard position and the holding position. When working oil is introduced into one of the chambers 23, 27, the vane rotor 14 is unlocked by the lock member 30. The normal mode is continued by the control circuit 70 until a compulsory mode is started at S104 to be described later.

At S101 subsequent to S100, it is determined whether a temperature of working oil exceeds a predetermined temperature ST. For example, the predetermined temperature ST is set as 100° C., that is an upper limit for forming an oil film of high-viscosity working oil so as to restrict air foam from being formed at a clearance of the driving unit 10 or the controller 40, that may become a suction port through which air is drawn when a negative pressure is generated in the chamber 22, 23, 24, 26, 27, 28. Therefore, a high temperature state to be detected at S101 is a state in which the temperature of working oil exceeds the predetermined temperature ST if the temperature of working oil exceeds the predetermined temperature ST, the viscosity of working oil is lowered, and the formation of the oil film becomes difficult, so that the air foam may be easily mixed into working oil. The temperature of working oil is indirectly estimated based on a temperature of cooling water or air intake amount obtained from a signal output from the sensor 8, 9. Alternatively, the temperature of working oil may be directly measured using an oil temperature sensor.

If the high temperature state is not detected in S101, the control flow is returned to S100. If the high temperature state is detected in S101, it is determined whether the engine continues to have a low rotation state for a predetermined period CT at S102. The engine is defined to have the low rotation state if a rotation speed of the engine is lower than a predetermined rotation speed N. The predetermined rotation speed N and the predetermined period CT are set in advance based on an estimation amount of air foam generated in a high rotation time thereafter (S104). If the rotation speed is lowered, a pressure of working oil supplied from the pump 4 is lowered, and introducing of working oil into the chambers 22, 23, 24, 26, 27, 28 becomes late, so that the air foam is mixed into working oil. For example, the predetermined rotation speed N is 1500 rpm, and the predetermined period CT is 5-seconds. The rotation speed of the engine is calculated based on a signal output from at least one of the crank sensor 6 and the cam sensor 7.

If the engine is not in the low rotation state in S102, or if the low rotation state of the engine does not continue for the period CT, the control flow is returned to S100. If the low rotation state of the engine continues for the period CT in S102, it is determined whether the engine shifts to a high rotation state where the engine has a rotation speed equal to or higher than the predetermined speed N at S103. S103 is repeated while the low rotation state is continued. If the engine is determined to shift to the high rotation state at S103, S104 is performed. That is, if the continuation of the low rotation state for the period CT is finished from when S102 is started, S104 is performed.

In S104 of the control flow, a compulsory mode is set as the engine control status in place of the normal mode. In the compulsory mode, flow of working oil relative to the chambers 22, 23, 24, 26, 27, 28 is controlled by controlling the energization of the solenoid 61, so as to compulsorily change the rotation phase alternately between the advance side and the retard side. For example, the compulsory change of the rotation phase is executed between the most advance phase in which the vane 143 contacts the shoe 121 and the most retard phase in which the vane 143 contacts the shoe 123. The compulsory change of the rotation phase is suitably started from any one of the advance side or the retard side. For example, the compulsory change of the rotation phase is started from the advance side that is opposite from the average torque Tave. Alternatively, the compulsory change of the rotation phase may be started from the same side of the normal mode (valve timing control) performed immediately before the compulsory mode is started.

At S105 subsequent to S104, it is determined whether a stop condition is satisfied. Specifically, it is determined whether a predetermined period RT is elapsed after the compulsory mode is started. The predetermined period RT is suitably set by considering a repetition number of the compulsory change of the rotation phase. For example, the predetermined period RT is 5-seconds that is necessary for discharging the air foam mixed in working oil from the chamber 22, 23, 24, 26, 27, 28.

S104 is repeated until the stop condition is satisfied at S105. If the stop condition is satisfied in S105, the control flow returns to S101, so that the normal mode is again executed.

According to the first embodiment, if the low rotation state is continued for the predetermined period CT or more, the pressure of working oil supplied from the pump 4 becomes smaller than 100 kPa, for example, so that air foam becomes easy to be mixed into working oil introduced into the chamber 22, 23, 24, 26, 27, 28. The mixing of the air foam becomes easy in the high temperature state because the oil formation is difficult by the low-viscosity working oil. If the engine has a high rotation after the low rotation is continued in the high temperature state, coefficient of elasticity of working oil containing the air foam becomes smaller. Further, due to the increasing of the peak torque T+, T− of the variation torque, the vane rotor 14 may have abnormal movement by elastic reaction force generated to the variation torque.

However, when the engine shifts to the high rotation state in the high temperature state after the low rotation state is continued for the predetermined period CT, the rotation phase is compulsorily changed alternately between the most advance phase and the most retard phase using working oil having high pressure. Therefore, the vane rotor 14 has the quickest rotation relative to the housing 12, so as to repeatedly minimize the volume of the chamber 22, 23, 24, 26, 27, 28. Thus, the air foam can be sufficiently discharged together with working oil. Accordingly, the vane rotor 14 can be restricted from having the abnormal movement.

According to the first embodiment, the compulsory change of the rotation phase is pinpointly performed at a necessary time. In this case, a rapid change in the engine operation state is restricted, and accurate valve timing control can be performed at a normal mode subsequent to the compulsory mode.

The pump 4 may correspond to a supply source, The controller 40 may correspond to a phase controller. S101, S102, and S103 may correspond to a condition for performing the compulsory mode.

Second Embodiment

Figure 4:
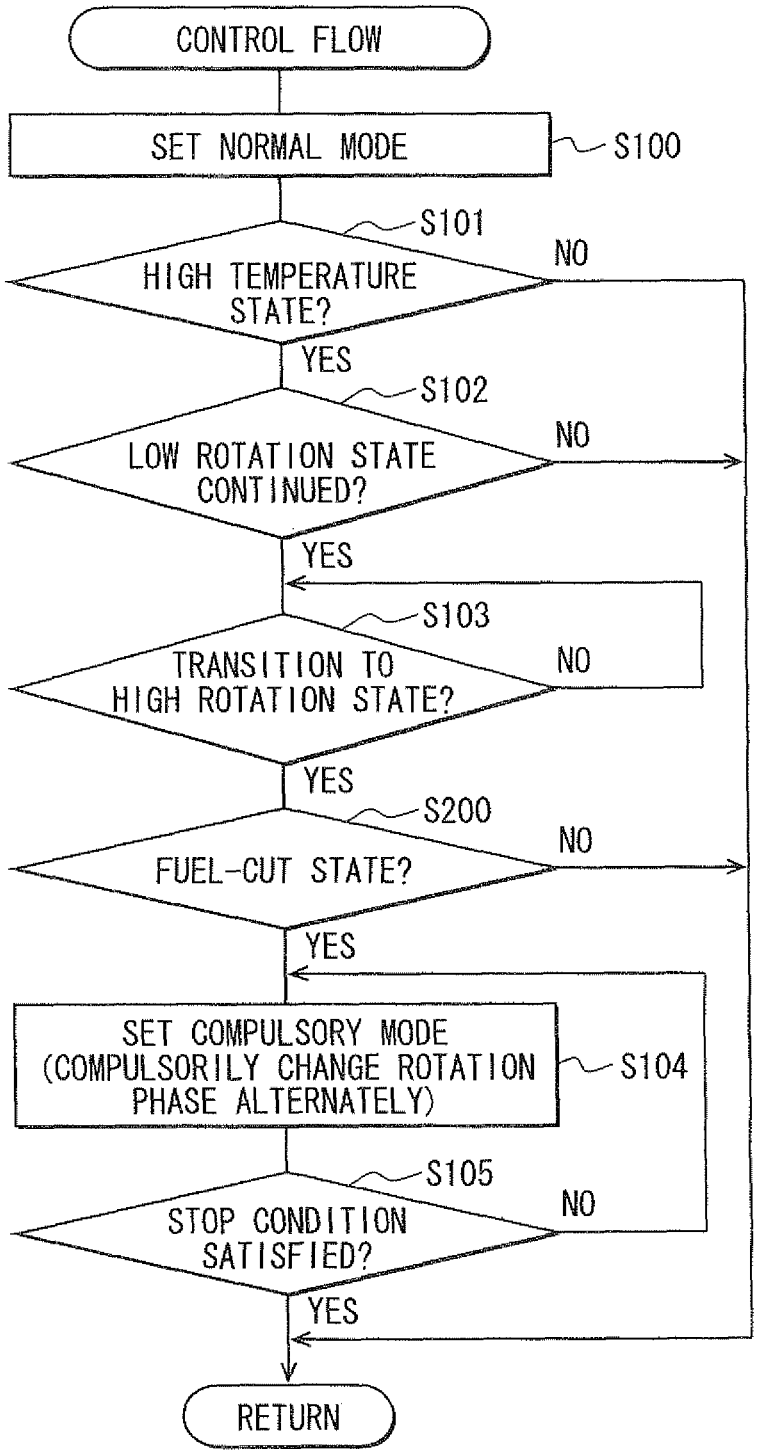
FIG. 4 is a flow chart illustrating a control flow performed by a control circuit of a valve timing control apparatus according to a second embodiment.

As shown in FIG. 4, S200 is added after S103 in a second embodiment, compared with the first embodiment.

Specifically, at S200, it is determined whether the engine has a fuel-cut state in which fuel injection is cut in a cylinder of the engine. If the engine has the fuel-cut state in S200, the compulsory mode is set in S104, so that the rotation phase is alternately changed. If the engine does not have the fuel-cut state in S200, the control flow returns to S101 by skipping S104 and S105.

According to the second embodiment, when the fuel injection is cut in the cylinder of the engine, fuel combustion in the cylinder is stopped, so that a rapid change in the engine operation state becomes difficult to be generated by the compulsory change of the rotation phase. Therefore, the rotation phase is compulsorily changed not only when the engine shifts to the high rotation state but also when the fuel injection is cut in the cylinder of the engine. Thus, the change in the engine operation state can be effectively restricted.

S101, S102, S103 and S200 may correspond to a condition for performing the compulsory mode.

Third Embodiment

Figure 5:
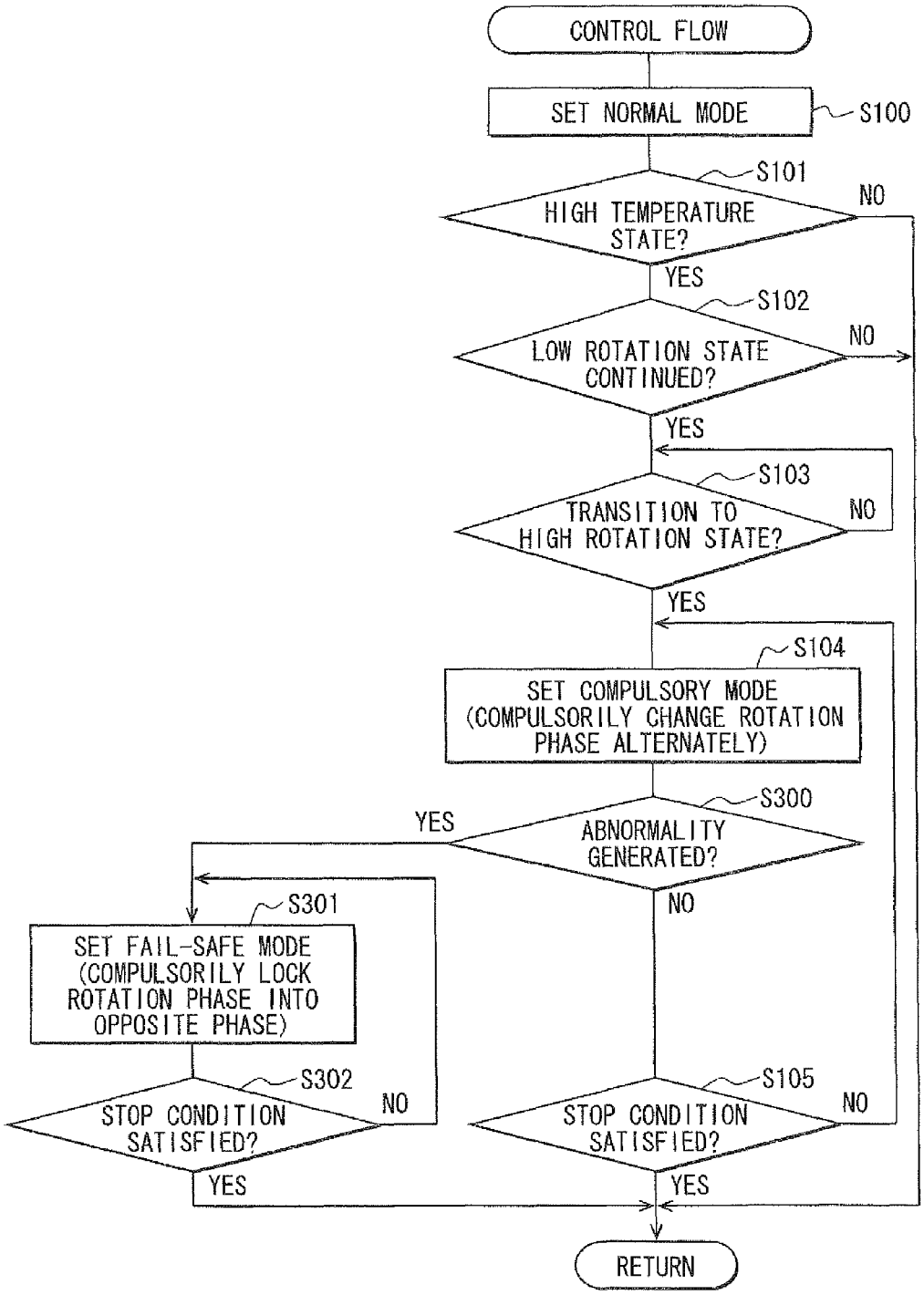
FIG. 5 is a flow chart illustrating a control flow performed by a control circuit of a valve timing control apparatus according to a third embodiment.

As shown in FIGS. 5, S300, S301 and S302 are added after S104 in a third embodiment, compared with the first embodiment.

Specifically, it is determined whether an abnormality is generated at S300. If the rotation phase does not reach one of the most advance phase and the most retard phase when the rotation phase is compulsorily changed, it is determined that the abnormality is generated. If the abnormality is not generated, the control flow proceeds to S105. If the abnormality is generated, the control flow proceeds to S301.

At S301, the engine control status is set as a fail-safe mode as for a flow of working oil with respect to the chamber 22, 23, 24, 26, 27, 28. In the fail-safe mode switched from the compulsory mode, the rotation phase is compulsorily locked into a phase opposite from the most advance phase or the most retard phase to which the rotation phase does not reach, by controlling the energization of the solenoid 61.

That is, if the rotation phase does not reach the most advance phase by abnormality, the vane 143 is made to contact the shoe 123 on the retard side by discharging working oil from the advance chamber 22, 23, 24 and by introducing working oil into the retard chamber 26, 27, 28, so as to compulsorily lock the rotation phase into the most retard phase.

In contrast, if the rotation phase does not reach the most retard phase by abnormality, the vane 143 is made to contact the shoe 121 on the advance side by introducing working oil into the advance chamber 22, 23, 24 and by discharging working oil from the retard chamber 26, 27, 28, so as to compulsorily lock the rotation phase into the most advance phase. While this state is kept, air foam inside of the chamber 22, 23, 24, 26, 27, 28 can be gradually discharged because oil pressure is applied into the chamber having the air foam by introducing working oil.

At S302 subsequent to S301, it is determined whether a stop condition of the fail-safe mode is satisfied. For example, it is determined whether a necessary period is elapsed. If the necessary period is elapsed, the air foam is discharged from the chamber 22, 23, 24, 26, 27, 28, so as to reach the most retard phase or the most advance phase.

Until the stop condition is satisfied at S302, S301 is repeated so as to continue the fail-safe mode. If the stop condition is satisfied, the control flow returns to S101, so that the normal mode is again executed.

According to the third embodiment, if an amount of the air foam in the chamber 22, 23, 24, 26, 27, 28 exceeds a predetermined threshold, the rotation phase cannot be compulsorily changed into the most advance/retard phase, so that the relative rotation of the vane rotor 14 is stopped by compulsorily locking the rotation phase on the opposite phase. Therefore, the vane rotor 14 can be restricted from having an abnormal movement not only in a normal time where the compulsory change of the rotation phase is possible, but also in an abnormal time where the compulsory change of the rotation phase is impossible. Thus, fail-safe can be achieved, and the valve timing can be accurately controlled.

Fourth Embodiment

Figure 6:
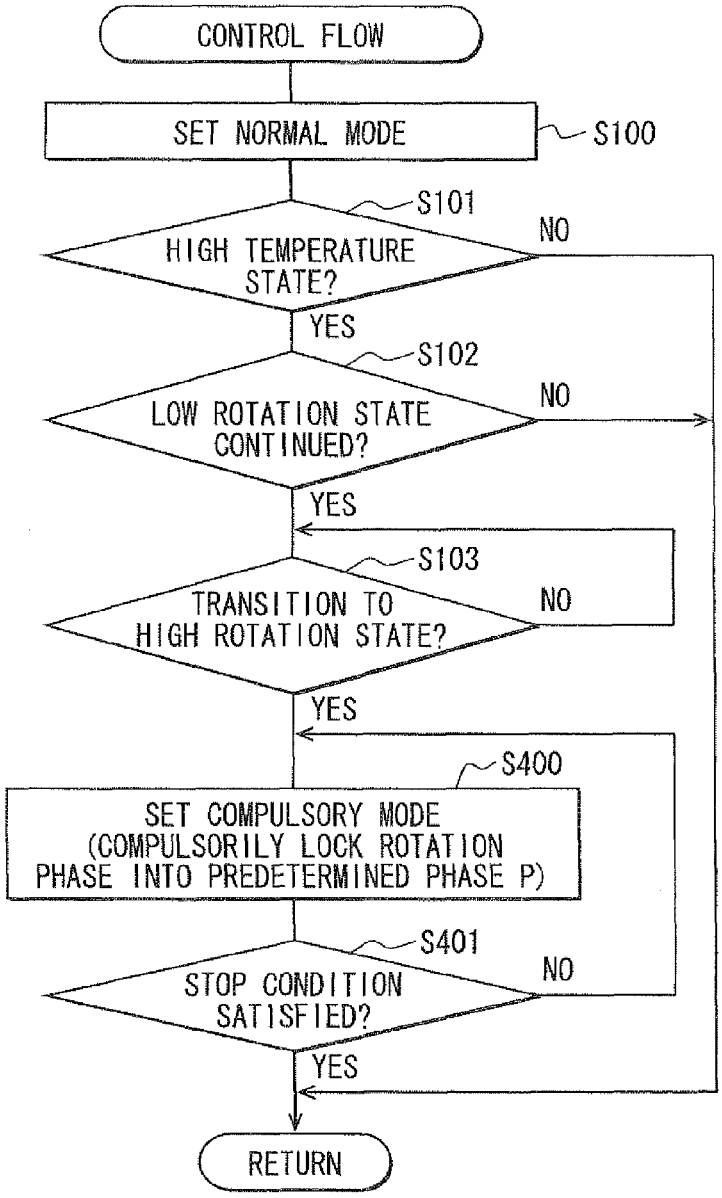
FIG. 6 is a flow chart illustrating a control flow performed by a control circuit of a valve timing control apparatus according to a fourth embodiment.

As shown in FIGS. 6, S400 and S401 are added in place of S104 and S105 in a fourth embodiment, compared with the first embodiment.

Specifically, in a compulsory mode of S400, the rotation phase is compulsorily locked into a predetermined phase P by controlling flow of working oil relative to the chambers 22, 23, 24, 26, 27, 28. For example, the predetermined phase P is set in advance as the most advance phase or the most retard phase. If the most advance phase is set as the predetermined phase P, the vane 143 is made to contact the shoe 121 on the advance side by introducing working oil into the advance chamber 22, 23, 24 and by discharging working oil from the retard chamber 26, 27, 28, so as to compulsorily lock the rotation phase into the most advance phase. In contrast, if the most retard phase is set as the predetermined phase P, the vane 143 is made to contact the shoe 123 on the retard side by discharging working oil from the advance chamber 22, 23, 24 and by introducing working oil into the retard chamber 26, 27, 28, so as to compulsorily lock the rotation phase into the most retard phase. When this state is kept, air foam inside of the chamber 22, 23, 24, 26, 27, 28 can be gradually discharged because oil pressure is applied to the chamber by introducing working oil.

At S401 subsequent to S400, it is determined whether a stop condition of the compulsory mode is satisfied. For example, it is determined whether a period necessary for discharging the air foam from the chamber 22, 23, 24, 26, 27, 28 is elapsed. If the necessary period is elapsed, the rotation phase can reach the predetermined phase P.

Until the stop condition is satisfied at S401, S400 is repeated so as to continue the compulsory mode. If the stop condition is satisfied, the control flow returns to S101, so that the normal mode is again executed.

According to the fourth embodiment, when the engine shifts to the high rotation state after the engine has the low rotation state for the period CT or more in a state that working oil has high temperature, the rotation phase is compulsorily locked into the predetermined phase P by using high-pressure working oil supplied from the pump 4. Therefore, not only the abnormal movement but also the relative rotation of the vane rotor 14 can be stopped. When the compulsory lock is pinpointly performed at a necessary time, a rapid change can be reduced in the engine operation state, and the valve timing can be accurately controlled in the subsequent normal mode.

Fifth Embodiment

Figure 7:
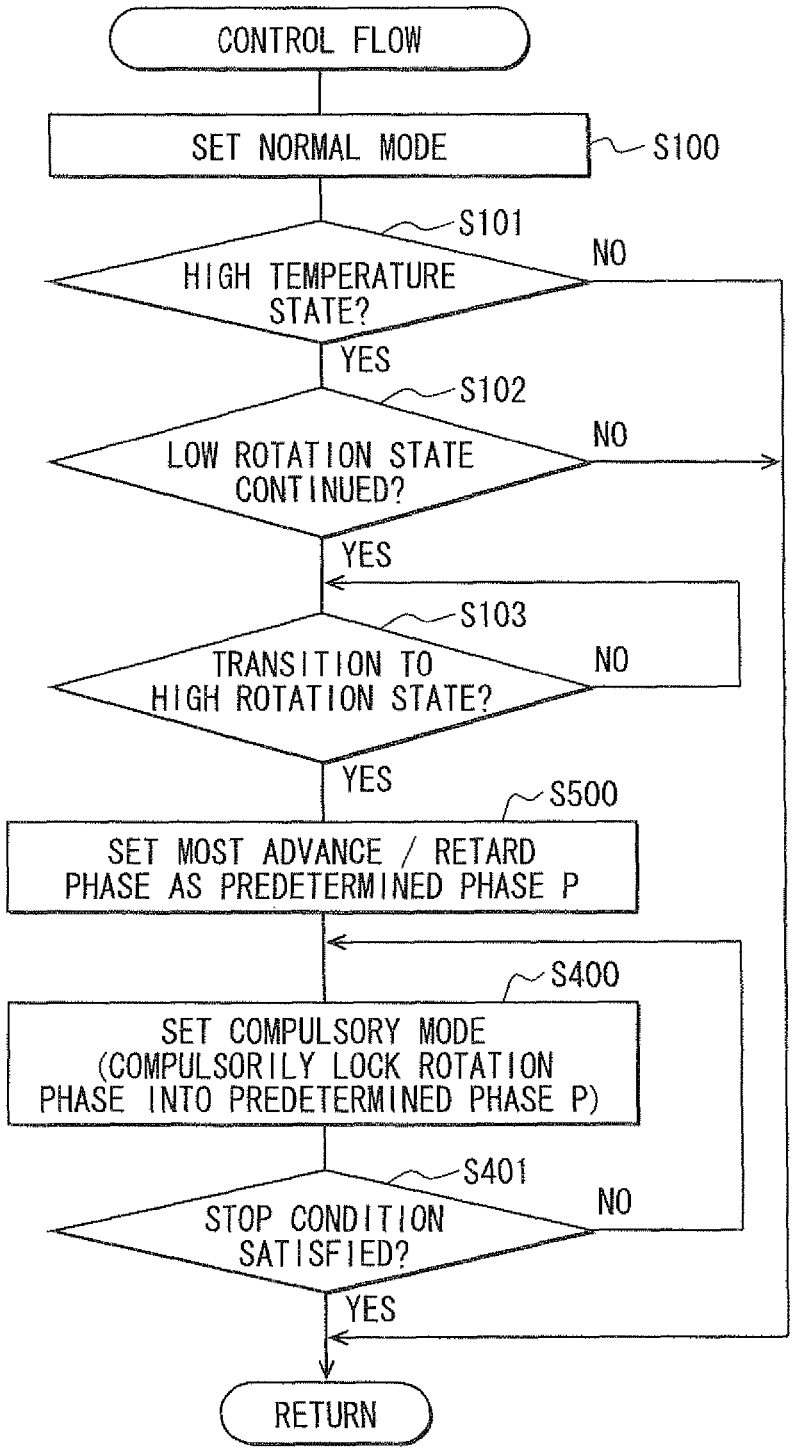
FIG. 7 is a flow chart illustrating a control flow performed by a control circuit of a valve timing control apparatus according to a fifth embodiment.

As shown in FIG. 7, S500 is added after S103 in a fifth embodiment, compared with the fourth embodiment.

Specifically, at S500, the rotation phase at the present time is calculated based on signals output from the crank sensor 6 and the cam sensor 7, and one of the most advance phase and the most retard phase that is adjacent to the present phase is set as the predetermined phase P. Therefore, at S400 subsequent to S500, the rotation phase is compulsorily locked into the phase P predetermined at S500.

According to the fifth embodiment, when the engine shifts to the high rotation state after the engine has the low rotation state for the period CT or more in a state that working oil has high temperature, the rotation phase is compulsorily locked into the predetermined phase P that is closer to the present phase. Therefore, a time necessary for making the present phase to reach the predetermined phase P can be made short. Thus, the vane rotor 14 can be restricted from having abnormal movement before reaching the predetermined phase P, and the valve timing can be accurately controlled in the subsequent normal mode.

Sixth Embodiment

Figure 8:
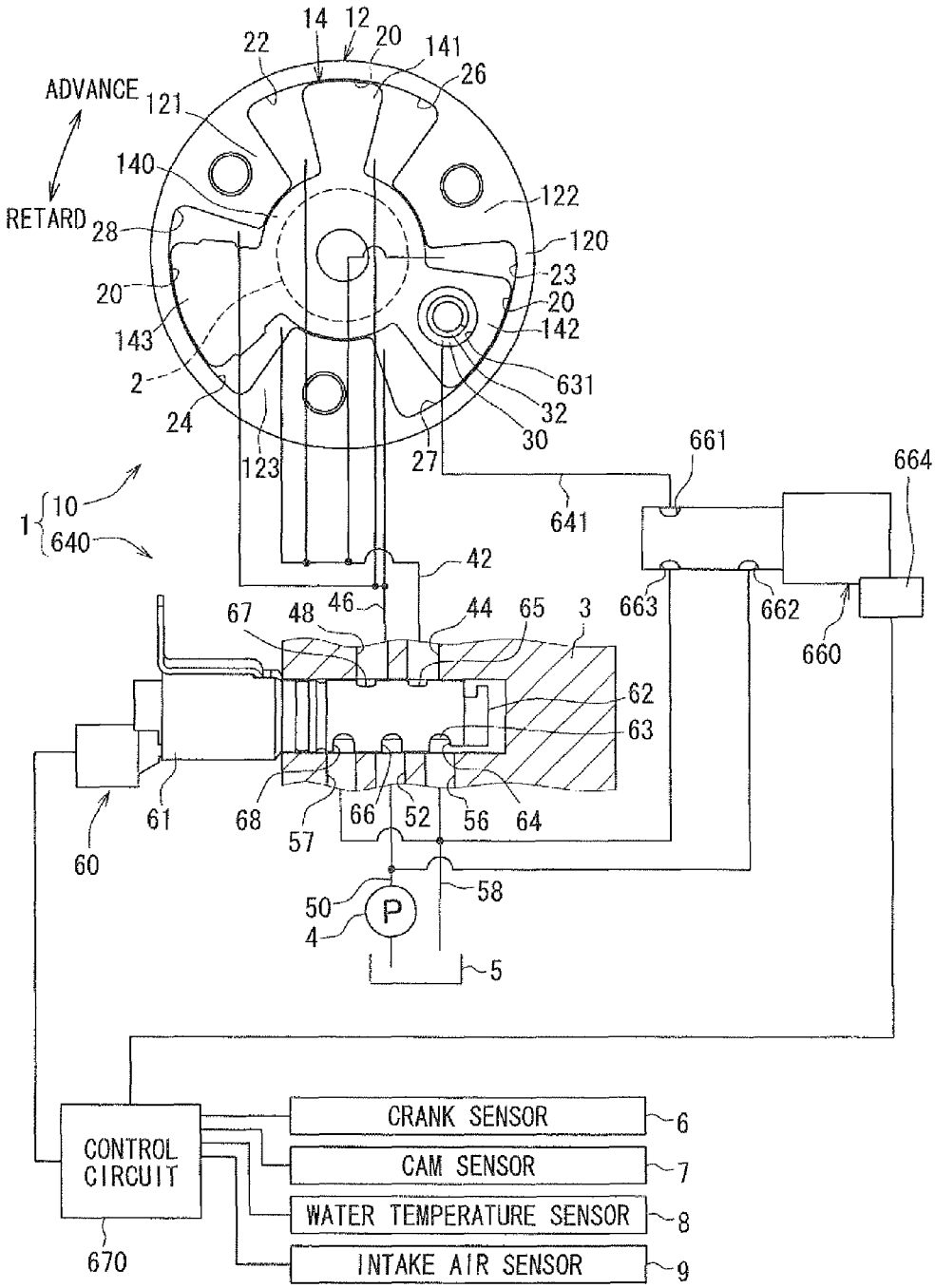
FIG. 8 is a schematic view illustrating a valve timing control apparatus according to a sixth embodiment.

As shown in FIG. 8, the fourth embodiment is modified in a sixth embodiment. Compared with the controller 40 of the fourth embodiment shown in FIG. 1, a controller 640 of the sixth embodiment further has a lock passage 641 and a lock drive valve 660, so as to drive the lock member 30 independently from operation of the control valve 60.

Specifically, the lock passage 641 passes through the vane rotor 14, and communicates with an accommodation chamber 631 to accommodate the lock member 30 in the vane rotor 14. The accommodation chamber 631 does not communicate with the advance chamber 23 and the retard chamber 27, and the other construction and function of the accommodation chamber 631 are similar to those of the accommodation chamber 31 of the first embodiment. Further, the lock passage 641 passes through the camshaft 2, and communicates with a lock port 661 of the lock drive valve 660.

The lock drive valve 660 is electrically connected to a control circuit 670, and connects/disconnects the lock port 661 to/from an inlet port 662 or a drain port 663 based on energization of a solenoid 664 from the circuit 670. The inlet port 662 communicates with the supply passage 50, and the drain port 663 communicates with the drain passage 58. Further, the control circuit 670 controls the energization of the solenoid 664 as a control of the engine in addition to the construction and function of the control circuit 70 of the first embodiment.

The control circuit 670 controls the energization of the solenoid 664, thereby switching the connection state among the ports 661, 662, 663, so as to control the flow of working oil relative to the chamber 631. Specifically, when the ports 661, 663 are connected with each other and when the ports 661, 662 are disconnected from each other, working oil is discharged from the chamber 631 to the drain pan 5. As a result, the lock member 30 is fitted with a fitting hole (not shown) of the housing 12 by the biasing force of the spring 32, so as to lock the vane rotor 14 into the middle lock phase (see FIG. 8) with respect to the housing 12. In contrast, when the ports 661, 662 are connected with each other and when the ports 661, 663 are disconnected from each other, working oil is introduced into the chamber 631 from the pump 4. As a result, the lock member 30 is separated from the fitting hole of the housing 12 by the pressure of working oil flowing into the chamber 631, so as to unlock the vane rotor 14 with respect to the housing 12.

Figure 9:
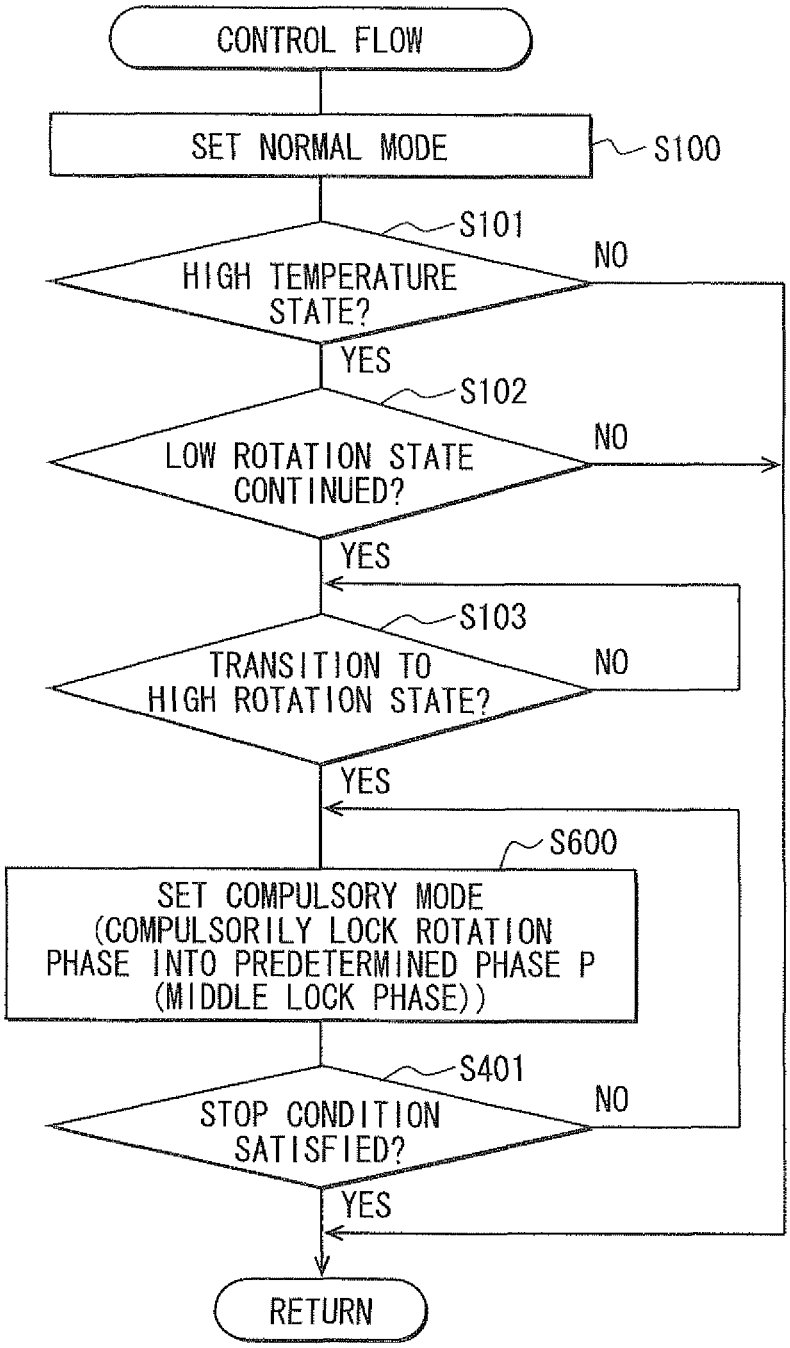
FIG. 9 is a flow chart illustrating a control flow performed by a control circuit of the valve timing control apparatus of the sixth embodiment.

As shown in FIG. 9 representing a control flow of the sixth embodiment, a compulsory mode is executed at S600 differently from S400 of the fourth embodiment. That is, in the compulsory mode of S600, the flow of working oil relative to the chamber 22, 23, 24, 26, 27, 28, 631 is controlled by the energization of the solenoid 61, 664, thereby compulsorily locking the rotation phase by the lock member 30 at the middle lock phase (see FIG. 8) as the predetermined phase P. Therefore, in a case where the present rotation phase at S600 is located on the advance side from the middle lock phase, the rotation phase is made to reach the middle lock phase by discharging working oil from the advance chamber 22, 23, 24 and by introducing working oil into the retard chamber 26, 27, 28. Then, the lock member 30 is made to fit with the fitting hole of the housing 12 by discharging working oil from the chamber 631. Thus, the vane rotor 14 is locked at the middle lock phase corresponding to the predetermined phase P with respect to the housing 12. In contrast, in a case where the present rotation phase at S600 is located on the retard side from the middle lock phase, the rotation phase is made to reach the middle lock phase by introducing working oil into the advance chamber 22, 23, 24 and by discharging working oil from the retard chamber 26, 27, 28. Then, by discharging working oil from the chamber 631, the vane rotor 14 is locked at the middle lock phase corresponding to the predetermined phase P with respect to the housing 12.

Similarly to the fourth embodiment, until the stop condition is satisfied at S401 subsequent to S600, S600 is repeated so as to continue the compulsory mode. If the stop condition is satisfied, the control flow returns to S101, so that the normal mode is again executed.

In the normal mode set by S101, when electricity is supplied to the solenoid 664 immediately after the normal mode is set, working oil is introduced into the accommodation chamber 631, so as to unlock the vane rotor 14.

According to the sixth embodiment, when the engine shifts to the high rotation state after the engine has the low rotation state for the period CT or more in a state that working oil has high temperature, the rotation phase is compulsorily locked into the predetermined middle lock phase P defined between the most advance phase and the most retard phase. Therefore, not only the abnormal movement but also the relative rotation of the vane rotor 14 can be stopped. When the compulsory lock is pinpointly performed at a necessary time, a rapid change can be reduced in the engine operation state, and the valve timing can be accurately controlled in the subsequent normal mode.

The controller 640 may correspond to a phase controller.

Other Embodiment

The present invention is not limited to the above embodiments. Changes and modifications are to be understood as being within the scope of the present invention as defined by the appended claims.

Figure 10:
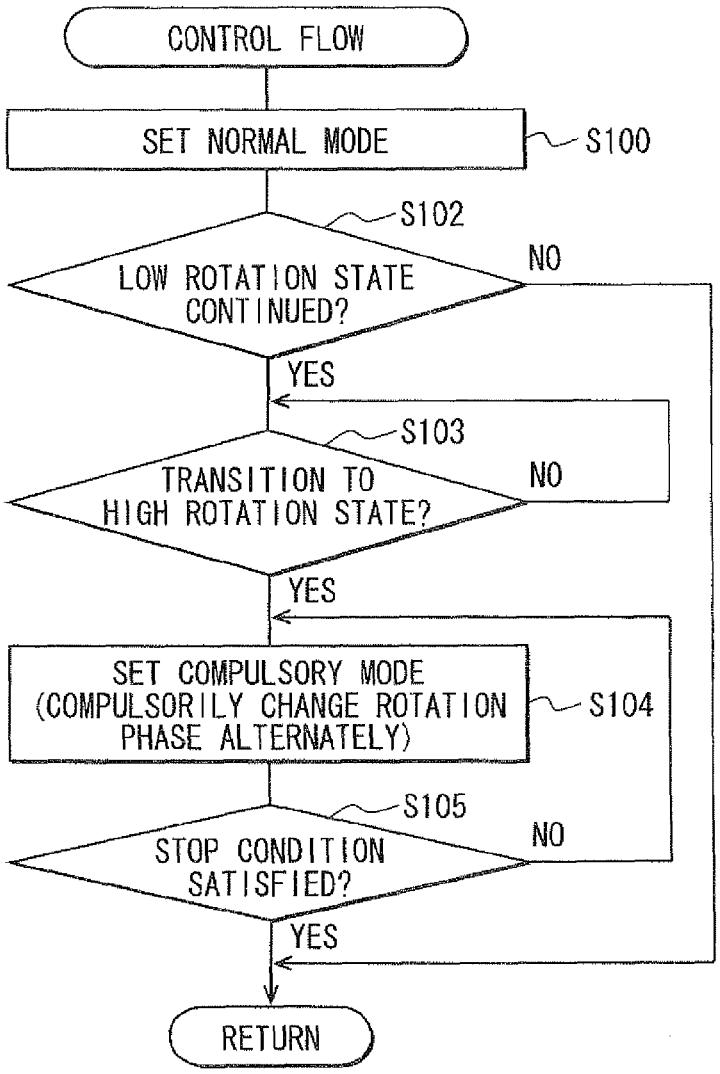
FIG. 10 is a flow chart illustrating a modification of the control flow of FIG. 3.

In the first to sixth embodiments, as shown in FIG. 10 defined by modifying the first embodiment, S101 may be omitted.

Figure 11:
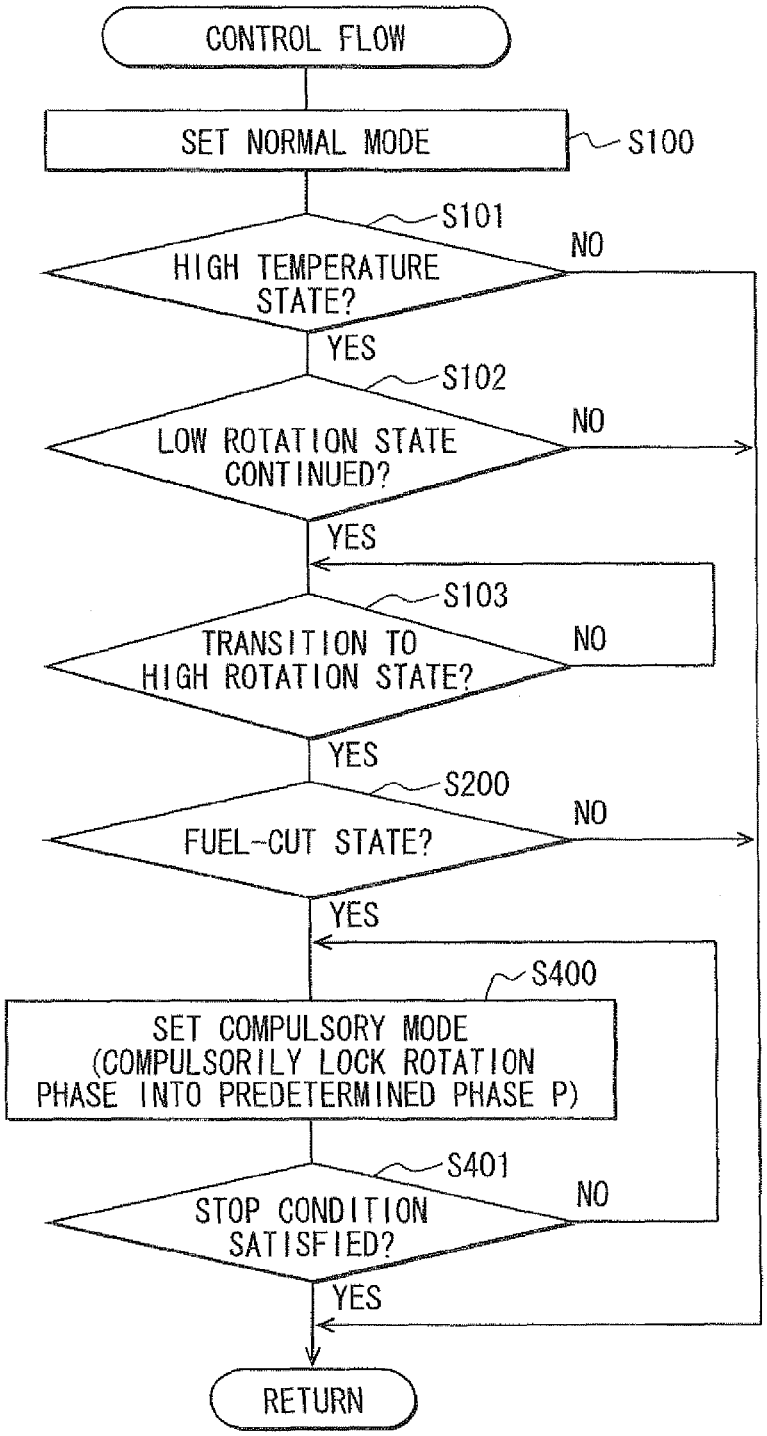
FIG. 11 is a flow chart illustrating a modification of the control flow of FIG. 6.

In the third to sixth embodiments and their modifications, as shown in FIG. 11 defined by modifying the fourth embodiment, similarly to the second embodiment, S200 may be performed after S103.

Further, the present invention may be applied to an exhaust valve other than the intake valve, or may be used for both of the intake valve and the exhaust valve.

Such changes and modifications are to be understood as being within the scope of the present invention as defined by the appended claims.

What is claimed is:

1. A valve timing control apparatus for controlling valve timing of a valve that is opened or closed by a camshaft through torque transmitted from a crankshaft in an engine of a vehicle, the valve timing being controlled using working fluid supplied from a supply source in synchronization with a rotation of the engine, the valve timing control apparatus comprising:

a housing that is rotatable with the crankshaft;

a vane rotor that is rotatable with the camshaft, the vane rotor having vanes partitioning an inside of the housing into plural operation chambers in a rotating direction, the vane rotor having a rotation phase with respect to the housing, the rotation phase being changed by working fluid flowing into or out of the operation chambers; and a phase controller configured to determine whether the engine continuously has a low rotation state for a predetermined time period or more, to determine whether the engine shifts to a high rotation state from the low rotation state, and to compulsorily change the rotation phase alternately between an advance side and a retard-side with respect to the housing by controlling working fluid to flow into or out of the operation chambers when it is determined that the engine shifts to the high rotation state after it is determined that the engine continuously has the low rotation state for the predetermined time period or more, wherein the engine in the low rotation state has a rotation speed lower than a predetermined rotation speed, and the engine in the high rotation state has a rotation speed equal to or higher than the predetermined rotation speed.

2. The valve timing control apparatus according to claim 1, wherein the phase controller compulsorily changes the rotation phase alternately between a most advance phase and a most retard phase with respect to the housing if the engine shifts to the high rotation state after the engine continuously has the low rotation state for the predetermined period or more.

3. The valve timing control apparatus according to claim 2, wherein in an abnormality case where the rotation phase does not reach one of the most advance phase and the most retard phase even when the rotation phase is compulsorily changed, the phase controller compulsorily locks the rotation phase into the other of the most advance phase and the most retard phase.

4. The valve timing control apparatus according to claim 1, wherein the phase controller compulsorily changes the rotation phase, if the engine shifts to the high rotation state after the engine continuously has the low rotation state for the predetermined period or more, and if a temperature of working fluid is higher than a predetermined temperature.

5. The valve timing control apparatus according to claim 1, wherein the phase controller compulsorily changes the rotation phase, if the engine shifts to the high rotation state after the engine continuously has the low rotation state for the predetermined period or more, and if a fuel injection is cut in the engine.

6. The valve timing control apparatus according to claim 1, wherein the phase controller stops the compulsorily changing of the rotation phase when a period necessary for discharging air foam from the operation chambers is elapsed.

7. A valve timing control apparatus for controlling valve timing of a valve that is opened or closed by a camshaft through torque transmitted from a crankshaft in an engine of a vehicle, the valve timing being controlled using working fluid supplied from a supply source in synchronization with a rotation of the engine, the valve timing control apparatus comprising:

a housing that is rotatable with the crankshaft;

a vane rotor that is rotatable with the camshaft, the vane rotor having vanes partitioning an inside of the housing into plural operation chambers in a rotating direction, the vane rotor having a rotation phase with respect to the housing, the rotation phase being changed by working fluid flowing into or out of the operation chambers; and a phase controller configured to determine whether the engine continuously has a low rotation state for a predetermined time period or more, to determine whether the engine shifts to a high rotation state from the low rotation state, and to compulsorily lock the rotation phase into a predetermined phase by controlling working fluid to flow into or out of the operation chambers when it is determined that the engine shifts to the high rotation state after it is determined that the engine continuously has the low rotation state for the predetermined time period or more, wherein the engine in the low rotation state has a rotation speed lower than a predetermined rotation speed, and the engine in the high rotation state has a rotation speed equal to or higher than the predetermined rotation speed.

8. The valve timing control apparatus according to claim 7, wherein the predetermined phase is a most advance phase or a most retard phase that is closer to a rotation phase when the engine shifts to the high rotation state after the engine continuously has the low rotation state for the predetermined period or more.

9. The valve timing control apparatus according to claim 7, wherein the phase controller compulsorily locks the rotation phase, if the engine shifts to the high rotation state after the engine continuously has the low rotation state for the predetermined period or more, and if a temperature of working fluid is higher than a predetermined temperature.

10. The valve timing control apparatus according to claim 7, wherein the phase controller compulsorily locks the rotation phase, if the engine shifts to the high rotation state after the engine continuously has the low rotation state for the predetermined period or more, and if a fuel injection is cut in the engine.

* * * * *